United States Patent [19]

Linden

[11] 4,172,596

[45] * Oct. 30, 1979

[54] RACQUET MEANS AND METHOD OF STRINGING SAME

[76] Inventor: Gaylord C. Linden, 7583 El Arco, Cucamonga, Calif. 91730

[ * ] Notice: The portion of the term of this patent subsequent to Jul. 5, 1994, has been disclaimed.

[21] Appl. No.: 812,602

[22] Filed: Jul. 5, 1977

Related U.S. Application Data

[63] Continuation-in-part of Ser. No. 587,141, Jun. 16, 1975, Pat. No. 4,033,582, which is a continuation of Ser. No. 446,780, Feb. 28, 1974, abandoned.

[51] Int. Cl.[2] ..... A63B 51/00

[52] U.S. Cl. ..... 273/73 D

[58] Field of Search ..... 273/73 R, 73 A, 73 C, 273/73 D, 73 E, 73 H; 73/145

[56] References Cited

U.S. PATENT DOCUMENTS

| | | | |
|---|---|---|---|
| 1,409,621 | 3/1922 | Tournier | 273/73 D |
| 1,687,848 | 10/1928 | Robinson et al. | 273/73 D |
| 2,610,056 | 9/1952 | Lovell | 273/73 D |
| 3,702,189 | 11/1972 | Galich | 273/73 D X |
| 3,751,034 | 8/1973 | Portz et al. | 273/73 D |
| 3,994,495 | 11/1976 | Stoffel | 273/73 D X |
| 3,994,496 | 11/1976 | Burchett | 273/73 A |
| 4,033,582 | 7/1977 | Linden | 273/73 D |

FOREIGN PATENT DOCUMENTS

| | | | |
|---|---|---|---|
| 362036 | 12/1931 | United Kingdom | 273/73 D |
| 409924 | 5/1934 | United Kingdom | 273/73 D |
| 566130 | 12/1944 | United Kingdom | 273/73 D |

OTHER PUBLICATIONS

"Popular Mechanics-Shop Notes"; 1934; pp. 131-134.

*Primary Examiner*—Richard J. Apley
*Attorney, Agent, or Firm*—John H. Crowe

[57] ABSTRACT

A method of stringing tennis racquets, and the racquets resulting therefrom, in which the string is secured to the racquet frame in the form of two isolated sections, namely, a main string section and a cross string section. Each of these two sections is formed from a single length of string and is tied off onto itself so that either section can be replaced without disturbing the other one. Because each of the two string sections is tied off onto itself, the racquet can be easily repaired by the mere replacement of either section found to be defective.

8 Claims, 4 Drawing Figures

RACQUET MEANS AND METHOD OF STRINGING SAME

CROSS-REFERENCE TO RELATED APPLICATIONS

This application is a continuation-in-part of my copending U.S. application Ser. No. 587,141, filed June 16, 1975, now U.S. Pat. No. 4,033,582 which is a continuation of my copending U.S. application Ser. No. 446,780, filed Feb. 28, 1974, now abandoned.

BACKGROUND OF THE INVENTION

This invention relates generally to a method of stringing tennis, and similar, racquets, and more particularly to such a method productive of racquets having superior playing qualities and which can be repaired more quickly and inexpensively than can racquets strung in conventional fashion.

Tennis racquets and racquets of similar character, such as badminton, racquet ball and squash racquets, have for years been strung in such a way that damage to the strings can only be repaired by either patching the damaged areas alone or by replacing the strings in their entirety. Patching is often difficult and time-consuming because each job requires its own plan of attack, depending upon knot positions, string patterns, availability of hole space for the accommodation of strings, etc. Patching is particularly difficult in areas near the corners of the racquet frame where the string holes in the frame carry multiple strands of string, and where it is occasionally necessary, for that reason, to enlarge with an awl one or more of the clear space areas within a hole or holes to make room for an additional strand, or strands, of the patching string. Consequently, the patching of tennis, and similar, racquets, is a time-consuming chore to the racquet stringer for which he is not always well compensated. Moreover, patching often results in a poor quality repair job, for which reason the better players generally prefer to have their racquets completely restrung rather than merely patched. Complete restringing is, however, rather costly, especially where the finer qualities of string are used. This is not difficult to understand when it is appreciated that the average tennis racquet requires in the neighborhood of 32 or 33 feet of string, which, when of high quality, results in a repair cost of something like $30.00 or $35.00 to the customer.

SUMMARY OF THE INVENTION

I have now provided, in the stringing method of this invention, means for producing tennis racquets and the like which lend themselves to repair techniques of simple and relatively inexpensive character minus the above-noted disadvantages of conventional patching procedures, on the one hand, and the relatively high cost of complete string replacement, on the other.

In one way of stringing a racquet by the method of this invention, two pieces of racquet string of predetermined lengths are affixed to the racquet frame in sequence to form a crossing network of strands in the frame suitably tensioned for effective usage of the racquet in the playing of tennis or other game for which it might be intended. One of the two lengths of string is affixed to the racquet frame to form only the main strings of the racquet, the resulting string section being hereinafter referred to as the main string section. The other length of string is secured to the frame to provide only the cross strings, the resulting string section being hereinafter referred to as the cross string section. Each of these two sections is tied off onto itself so that the sections are isolated from one another to permit the removal of either one for purposes of racquet repair as described below. The term "isolated", as employed herein, means that the separate string sections have no interconnecting knots.

Since, as indicated above, the two sections of string in racquets strung in accordance with present teachings are isolated from one another, it is a simple matter for a professional stringer to replace either of the sections without disturbing the remaining one. Thus, the stringer can tailor his repair work to the needs of the individual player who might, for example, as a result of his playing style, wear out one or more sets of main strings before his cross strings need replacement, or vice-versa. Racquets strung in accordance with the present method can be patched in the same manner as conventionally strung racquets, but the results are no more satisfactory here than in the case of the latter, where, as previously indicated, the patching is often difficult and time consuming for the stringer and the repair work is frequently of poor quality (because of loose strings or the like). Where the alternative to patching repair of conventionally strung racquet is the replacement of all of its strings, however, the alternative to such repair of racquets strung in accordance with this invention is generally the replacement of only one of its two string sections. As will be seen, the two pieces of string from which these sections are formed are of somewhat comparable lengths, which means that the replacement of a single section of string on the racquet requires only about half the amount of string required to completely restring it. This, of course, reduces the cost, in string, of many repair jobs to about half that of a complete restringing job while restoring the repaired racquets to near top playing efficiency, in contrast to conventional patchwork which sometimes, as previously indicated, fails to achieve such a result.

It is thus a principal object of the present invention to provide a method of stringing tennis racquets, and the like, capable of producing high quality racquets of good playing effectiveness that lend themselves to the repair of broken or defective strings by means short of complete restringing, which repair can be accomplished at substantially less than the cost of such restringing yet is productive of sufficiently good results to restore the racquets to substantially their full playing effectiveness.

Other objects, features, and advantages of the invention will become apparent in the light of subsequent disclosures herein.

DESCRIPTION OF THE PREFERRED EMBODIMENT

Figure 2:
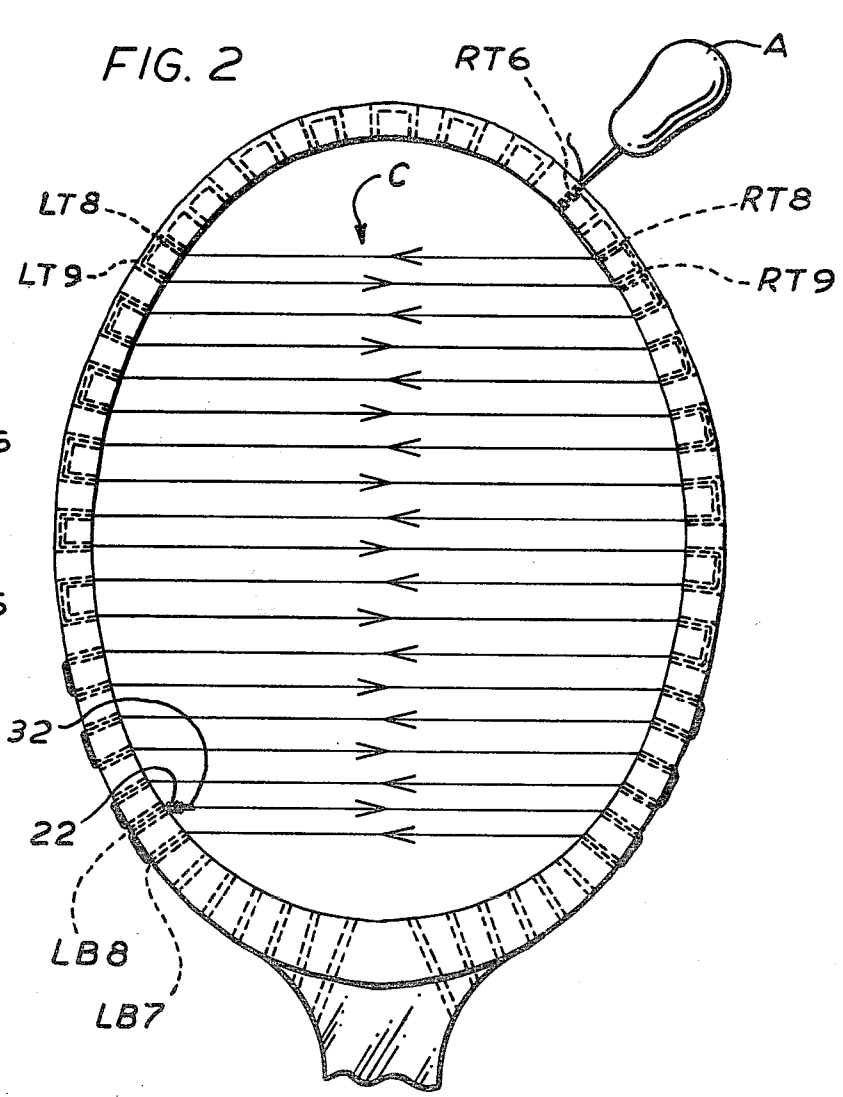
FIG. 2 is another view of the tennis racquet frame, this time fitted with a second length of string to illustrate a second step of the preferred method of the invention.
Figure 1:
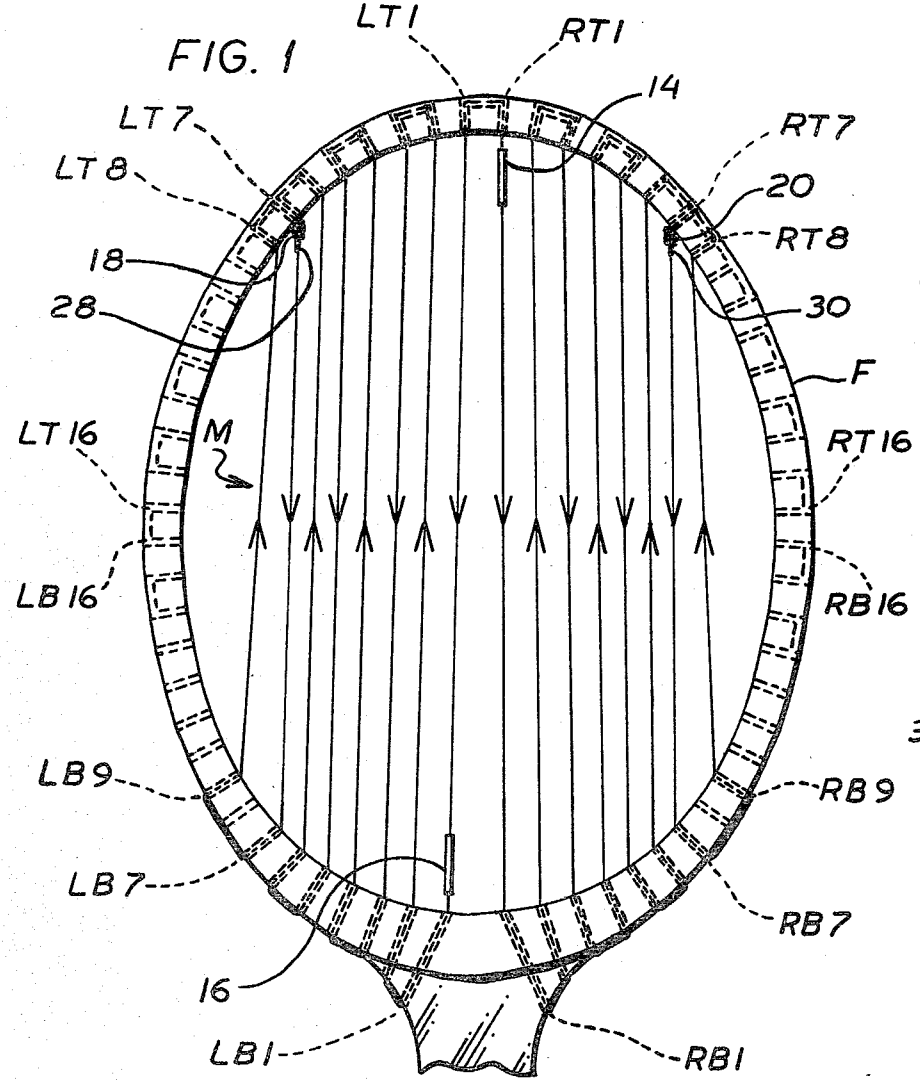
FIG. 1 is a front view of the frame of a wooden tennis racquet fitted with a first length of string to illustrate an initial stringing step of a preferred embodiment of the method of this invention.

Considering now the drawings in greater detail, FIG. 1 is a front view of the frame of a fairly typical wooden tennis racquet (such as the Dunlop Maxply Fort racquet distributed by the Dunlop Sports Division of Dunlop Tire and Rubber Co., of Buffalo, New York) with a main string section of string in accordance with this invention attached; and FIG. 2 is another front view of the frame with a cross string section of string in accordance with the invention attached. The two sections of string shown in FIGS. 1 and 2 symbolize two steps comprising a preferred racquet stringing method in accordance with the present invention. In the actual practice of this method, the two steps are preferably performed in the above-indicated sequence, that is, the FIG. 1 main string section is first affixed to the racquet frame and then the FIG. 2 cross string section is affixed to complete the string network and give the racquet the appearance illustrated in FIG. 3.

Figure 3:
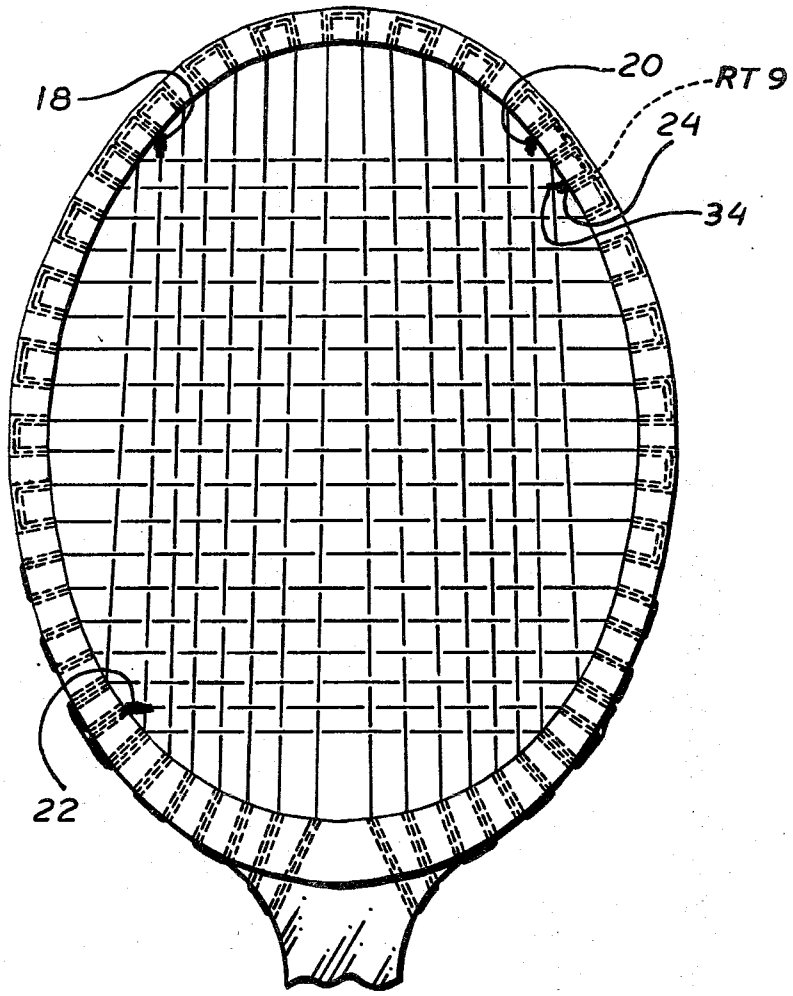
FIG. 3 is a front view of the tennis racquet frame fully strung in accordance with said method.

To more clearly demonstrate the aforesaid stringing method, FIG. 2 shows only the section of string added by the second step mentioned above, although it will, of course, be understood that the FIG. 2 cross string section is, in actual practice, superimposed upon the FIG. 1 main string section in the second step to complete the stringing of the racquet and give it the appearance shown in FIG. 3. The order of stringing steps set forth above, while preferred for purposes of my invention, is not critical and can, if desired, be reversed within the scope of the invention. As the second section of the network of racquet string is built up, the individual strads are interwoven with the strands of the first section into the fabric pattern shown in FIG. 3, which is similar to that of racquets strung in conventional fashion.

In FIG. 1 the aforesaid racquet frame is shown at F and the completed main string section of string at M. That section is strung from a sixteen foot length of suitable string (preferably lamb gut string, although it could be any other type of string available for use in tennis racquets, such as, for example, beef gut, hot gut, nylon or silk string). As those familiar with the design of tennis racquets are aware, the left and right halves of a typical wooden tennis racquet frame, as seen in FIG. 1, have equal numbers of corresponding holes in the frame structure through which the racquet string is threaded to permit fastening of the string to the frame. In the FIG. 1 frame (which is, as previously indicated, typical of the vast majority of wooden racquet frames) there are sixty-four such holes, thirty-two on each side. These holes are spaced around the frame from points near the center of its top to points near the center of its bottom or throat, sixteen of them occurring in each quadrant. For ease of identification hereinafter, the holes will be identified by quadrant and number, the numbers for each quadrant running in sequence from the top, or bottom, center of the frame, from one through sixteen. For example, the first hole to the left of the top center of the frame will be identified as LT1, the first hole to the right of that center as RT1, the first hole to the left of the bottom center as LB1, and the first hole to the right of that center as RB1. In this numbering system, the lowest hole in the left top (LT) quadrant would be identified as LT16, the lowest hole in the right top quadrant as RT16, the highest hole in the left bottom quadrant as LB16, and the highest hole in the right bottom quadrant as RB16. See FIG. 1, in which the first and last holes of the four quadrants are identified in this fashion.

FIG. 1 illustrates my preferred way of stringing main string section M on frame F. A sixteen-foot length of string is used for the main string section, which section is formed by first running the two halves of the string downwardly through the LT1 and RT1 holes in the racquet frame and clamping it at 14 and 16, respectively. The halves of the string are then fed downwardly and upwardly through the holes in the two halves of the racquet frame in the manner indicated by the directional arrows on FIG. 1, until holes one through seven at the top and bottom of the frame are all occupied and the two ends extend downwardly through holes LB7 and RB7, respectively. The left hand end is then passed inwardly through LB9, outwardly through LT8, and inwardly through LT7, where it is tied off on itself, as indicated at 18. In like manner, the right hand end of the string is passed from RB7 to RB9 and then threaded inwardly through that hole and outwardly through RT8 and inwardly through RT7, where it is tied off onto itself as shown at 20. After completion of the main string section, the racquet is ready to receive the cross string section in the second, and final, step of the stringing process, the latter section being shown at C in FIG. 2. A fifteen-foot length of string is used to form the cross string section, one end being threaded inwardly through RT9 and outwardly through RT6, where it is awled with the awl A, as illustrated. A half hitch knot, not shown, could be used temporarily at the awl position if desired. The string is then worked back and forth across the racquet frame from RT8 to LT8, LT9 to RT9, etc., down to LB7, where it is passed outwardly, and then inwardly through LB8. The string, now substantially used up, is tied off at LB8, as indicated by the tie-off knot at 22. After it is tied off at LB8, the string is clamped at RT8, and then awled at RT9. Awl A is next removed from RT6 and the string is pulled inwardly through RT6, after which it is tied off at RT9 (see FIG. 3, where the tie-off knot can be seen at 24). The racquet is now completely strung, and has the appearance shown in FIG. 3.

Where the racquet being strung as illustrated in the accompanying drawings is a Dunlop Maxply Fort racquet, the string grooves in the outer rim of its frame will readily accommodate the string pattern of the cross string section C. They will also accommodate the string pattern of the main string section M, except between holes LT7 and LT8, where a single groove must be cut in the frame for the last loop of the left half of the string section just short of knot 18. Here, as well as in any case where a particular racquet's string grooves do not fully satisfy the demands of my novel stringing method, however, a properly equipped, experienced stringer will have no difficulty in grooving the racquet frame as required by the circumstances.

As will now be apparent, my illustrated racquet stringing technique results in a racquet with two sections of string isolated from one another in the sense that there are no interconnecting knots therebetween so that they are separately removable for repair purposes. Generally, the strands of only one of these sections require replacement before those of the other section. When this occurs, the stringer need only replace the section with the defective strands to repair the racquet.

He is thus spared the time-consuming necessity of a patch job, and the repaired racquet is almost as good as new at roughly one-half the cost, in string, of a substantially equivalently effective repair job on a conventionally strung racquet. The string pattern of the string sections of this invention differ from the patterns of more conventionally strung racquets, but much of the actual stringing work is performed similarly to the way conventional stringing is carried out. My technique differs in several respects from conventional stringing techniques, however, particularly in the awling procedure used for starting and winding up the stringing of the cross string section. The work can be carried out with any of several commercially available stringing machines, but the preferred machine is the Serrano No-Awl Stringer, manufactured by Tennis Machines Co. of St. Louis, Missouri. Where such a machine is employed for the removal and replacement of the main strings in a racquet strung in accordance with the method of this invention, however, the racquet is preferably placed in the machine at a 90° angle from its normal position therein to prevent distortion of the shape of its head due to forces exerted on the head by the cross strings.

As previously indicated, the novel stringing method of this invention is not limited to use on tennis racquets, and can be employed for use in connection with any similar type of racquet requiring strings, such as, for example, a badminton, racquet ball or squash racquet. The heart of my invention resides in the concept of stringing such a racquet in two isolated sections so as to permit the replacement of either section without disturbing the other one, thereby rendering the racquet relatively easy to repair for the benefit of sporting goods shops, specialty tennis pro shops and players. The invention is not limited to use of the particular string section patterns illustrated in the drawings, but is sufficiently broad to encompass isolated main and cross string sections that differ therefrom yet serve the basic purposes taught herein.

The method of the present invention is not limited to use in the stringing of wooden racquets, but can be employed for the stringing of racquets of any type, such as, for example, those of steel, aluminum, plastic or any other construction. The pattern of string receiving holes in racquet frames, or equivalent means for permitting the attachment of strings to racquets, can vary from one brand or type of racquet to another. One skilled in the art would, however, with the aid of present teachings, be capable of arriving at suitable patterns for the stringing of isolated sections of string in accordance with this invention in any such frame.

The tie-offs at the ends of the separate strings of my main and cross string sections can be made with any conventional type of tie-off knot, although the knot I prefer to use for this purpose comprises two half hitches. In conventional racquets, the tie-off knots are fastened directly to taut strands of string, and this is conducive to excessive wear and strain on, and possible early failure of, the strings at the tie-off points. I have discovered, in this connection, that such difficulty can be substantially overcome by fitting a short (e.g., ⅜-inch) length of plastic (preferably Teflon) tubing around the strand receiving each knot. Four such pieces of plastic tubing can be seen at 28, 30, 32 and 34 on the drawings showing the tie-off points for the two string sections of the illustrated racquet. The tubing serves to cushion the string against the squeezing forces of the surrounding knot, and thus prolongs the life of the string. The use of suitable plastic tubing in this fashion is not critically necessary to the practice of my invention, however, nor is it, for that matter, limited to such practice, but has applicability in conventional racquet stringing methods as well. Longer pieces of the Teflon tubing can be used to protect those loops of the main strings passing through the throat openings in the racquet frame against undue wear, if desired, although such pieces of tubing are not shown on the drawings. To insure against loosening of the tie-off knots of the string sections, a suitable glue or cement (a clear household cement of any well known brand being satisfactory for the purpose) can be applied to the knots. This is merely an optional refinement, however, and not a critically necessary part of the method of this invention.

Figure 4:
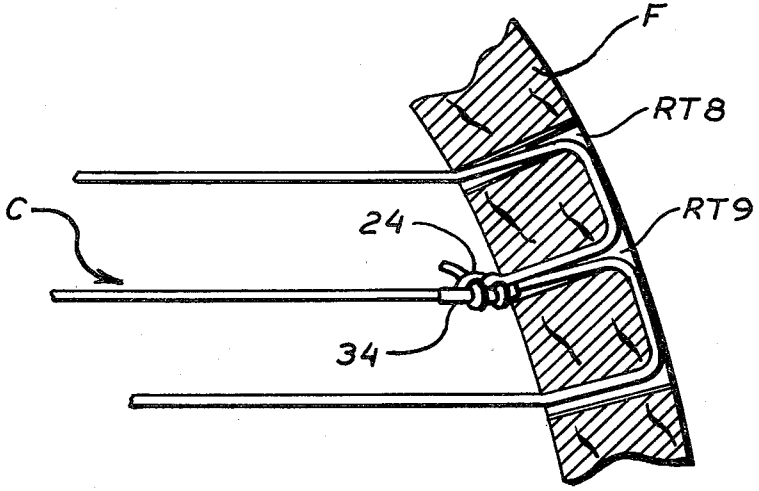
FIG. 4 is an enlarged fragmentary sectional view showing a portion of the tennis racquet frame, segments of said second length of string and a knot by means of which the upper end of the string is tied off onto itself to help hold such string firmly in position in the frame.

The general manner in which each of the two string sections is tied off onto itself at each end is illustrated in FIG. 4, which shows an enlarged view of the tie-off knot 24 at the upper end of the cross string section C (see FIG. 3 for the location of the knot in the racquet). As FIG. 4 illustrates, the knot 24 is tied around the second strand from the top of cross string section C, at a point closely adjacent the inner end of the hole RT9 in frame F (the knot actually, as previously indicated, being tied around a short segment of Teflon tubing 32 surrounding the string at the tie-off point to protect it against undue wear at that location). The knot 24 is a double half hitch knot, although, as made clear above, any other suitable type of knot could be employed in lieu thereof if desired. While, as indicated, a suitable cement can be applied to knot 24, no such cement is shown in FIG. 4 since the presence of the cement might tend to obscure certain details of the knot configuration. The cross string section C, as FIG. 4 clearly shows, extends outwardly through hole RT9 from the knot 24, then inwardly through RT8 to the opposite side of racquet frame F where it makes a U-turn at holes LT8 and LT9 (see FIG. 2) and returns to extend outwardly through RT9, from whence it follows the pattern shown in FIG. 2 to completion of that section at knot 22.

As indicated, my novel method can be used for the stringing of any type of racquet of the class including tennis, badminton, racquet ball and squash racquets. Some well known examples of the wide variety of such racquets include the steel International Mark 2 tennis racquet, the Evonne Goolagong tennis racquet, Power Point squash racquet and Maxply Fort badminton racquet, all distributed by Dunlop Sports Division of Dunlop Tire and Rubber Corp.; the aluminum Master tennis racquet, Arthur Ashe competition tennis racquet (of plastic and sheet aluminum construction) and Professional, all manufactured by Head Ski Division of AMF Incorporated (Boulder, Colorado); the Smasher III (aluminum tennis racquet), Pancho Gonzales Autograph (wood tennis racquet), Kro Bat squash racquet, and Match Play paddle racquet, all manufactured by Spaulding Division of Questor, Chicopee, Mass.; and the Stan Smith Autograph tennis racquet (wood), Pro Staff squash racquet and Carlton badminton racquet (steel all manufactured or distributed by Wilson Sporting Goods Co. of River Grove, Illinois.

While the novel racquet stringing method of this invention has been herein illustrated and described in what I consider to be its preferred embodiment utilizing two string sections, it will be understood by those skilled in the art that various departures may be made therefrom within the scope of the invention. Some of these departures have already been mentioned, and others will occur to those skilled in the art in the light of present teachings. For example, in the method of stringing cross string section C, the clamping of the string at RT8 prior to awling, or wedging, it at RT9 can be omitted if desired because it is only a preferred, and not a critically necessary, part of my stringing procedure.

Although this description has been limited to my stringing method, per se, I wish to make it clear that the present invention is not limited to that method, but also includes racquets strung in accordance therewith. In summary, the scope of the invention extends to all variant forms thereof encompassed by the language of the following claims.

I claim:

1. A method of stringing a tennis racquet or the like comprising the steps of:

providing a racquet frame having a plurality of string holes distributed in a predetermined pattern around its head, a first piece of string of suitable length to form an entire main string section consisting of a plurality of main strings passing through the area enclosed by said head in the longitudinal direction and a second piece of string of suitable length to form an entire cross string section consisting of a plurality of cross strings passing through the area enclosed by said head in the transverse direction; stringing each piece of string separately through appropriate holes in the head of said racquet to form the main string and cross string sections within said area, said sections being adapted to cooperate to form a complete string mesh for the racquet;

the stringing of the two pieces of string including the steps of securing each piece near each end in a way to firmly anchor each string section in position in the racquet frame under suitable tension for efficient use of the racquet; and said stringing being done in such a way that neither piece of string is secured to the other, whereby each piece of string is sufficiently isolated from the other so that it can be replaced without disturbance of said other.

2. A method in accordance with claim 1 in which the securing of each of the two pieces of string near each end comprises the tying off of the string near each end to a tightened strand of the string section formed from that piece of string at a point adjacent the inner periphery of said head to form a suitable knot at that point.

3. A method in accordance with claim 2 in which said main string section is strung first and then the cross string section is strung.

4. A method in accordance with claim 3 including the step of placing a section of plastic tubing on each strand of said string sections around which a knot is tied during the stringing of said racquet, the section of tubing being placed at the knot position prior to the tying of said knot so that the knot subsequently bears on the tubing, whereby said each strand is cushioned against the constrictive cutting force as a result of the presence of said knot at the tie-off point.

5. A method in accordance with claim 2 in which the cross string section is strung by threading a first end of the appropriate piece of string inwardly through a first hole through which will pass the strand on which that piece of string is to be tied near said first end and outwardly through a second string hole removed at least two hole spaces from said first string hole, then wedging the string in said second string hole;

stringing the remainder of said appropriate piece of string in its proper pattern in the racquet frame head to form said cross string section;

tying the second end of said appropriate piece of string off onto an appropriate strand of the cross string section;

wedging said appropriate piece of string in said first string hole;

freeing said appropriate piece of string from its wedged confinement in said second string hole and pulling the freed end back out of the second hole; and tying off said piece of string near said freed end onto said strand adjacent the inner end of said first string hole.

6. A tennis racquet or the like comprising a racquet frame with a head, said frame having two separate pieces of string affixed to its head under tension so as to form a main string section consisting of a plurality of main strings passing through the area enclosed by the said head in the longitudinal direction and a cross string section consisting of a plurality of cross strings passing through said area in the transverse direction, said sections cooperating to form complete string mesh for the racquet, the piece of string comprising each section being secured at each end to firmly anchor it in position in the racquet for suitable tension for efficient use of the racquet;

said sections having no interconnecting means, whereby each section is sufficiently isolated from the other to permit it to be replaced without disturbance of said other.

7. A tennis racquet or the like in accordance with claim 6 in which the piece of string comprising each of said sections is secured at each end by being tied off onto a strand of the section formed thereby adjacent the inner periphery of the head of said racquet frame.

8. A tennis racquet or the like in accordance with claim 7 including a plurality of sections of suitable tubing respectively positioned around the strands of said sections where the ends of said pieces of string are tied off therearound to cushion said strands against constrictive cutting force as a result of the presence of the knots at the tie-off points.

* * * * *